US005397438A

United States Patent [19]

Nyberg et al.

[11] Patent Number: 5,397,438

[45] Date of Patent: Mar. 14, 1995

[54] METHOD AND DEVICE FOR REDUCTION AND EQUALIZATION OF TRANSVERSE SHRINKAGE OF PAPER IN SINGLE-WIRE DRAW IN A DRYING SECTION

[75] Inventors: Petri Nyberg; Heikki Ilvespaa; Kari Holopainen, all of Jyvaskyla, Finland

[73] Assignee: Valmet Paper Machinery, Inc., Helsinki, Finland

[21] Appl. No.: 46,561

[22] Filed: Apr. 12, 1993

Related U.S. Application Data

[63] Continuation-in-part of Ser. No. 727,104, Jul. 8, 1991, abandoned.

[30] Foreign Application Priority Data

Jul. 6, 1990 [FI] Finland ..... 903423

[51] Int. Cl.[6] ..... D21F 5/04; D21F 7/12

[52] U.S. Cl. ..... 162/207; 34/116; 34/117; 162/902

[58] Field of Search ..... 162/207, DIG. 1, 375, 162/290, 193, 902; 34/111, 116, 117

[56] References Cited

U.S. PATENT DOCUMENTS

| | | | |
|---|---|---|---|
| 3,868,780 | 3/1975 | Soininen et al. | 34/117 |
| 4,460,023 | 7/1984 | Mullaney | 162/DIG. 1 |
| 4,494,319 | 1/1985 | Rudt | 34/116 |
| 4,680,873 | 7/1981 | Fellers et al. | 34/117 |
| 4,757,619 | 7/1988 | Villalobos | 34/116 |
| 4,799,318 | 1/1989 | Hannson | 34/117 |
| 4,807,371 | 2/1989 | Wedel | 34/117 |
| 4,854,053 | 8/1989 | Skaugen | 34/117 |
| 4,972,608 | 11/1990 | Ilvespaa | 34/117 |

*Primary Examiner*—Karen M. Hastings

*Attorney, Agent, or Firm*—Steinberg, Raskin & Davidson

[57] ABSTRACT

The present invention relates to a method and device in the draw of a paper web for reduction and equalization of transverse shrinkage of the paper web in the drying section of a paper machine. The lateral areas of the wire running in conjunction with the paper web are provided with a coating adhesion means, whereby, by means of the coating adhesion means, at the drying stage an adhesion force is produced between the lateral areas of the wire and of the paper to prevent transverse shrinkage of the paper web.

9 Claims, 4 Drawing Sheets

METHOD AND DEVICE FOR REDUCTION AND EQUALIZATION OF TRANSVERSE SHRINKAGE OF PAPER IN SINGLE-WIRE DRAW IN A DRYING SECTION

This application is a continuation-in-part application of U.S. Ser. No. 07/727,104 filed Jul. 8, 1991 now abandoned.

BACKGROUND OF THE INVENTION

A principal objective in paper manufacturing techniques is to achieve properties of paper which are as uniform as possible. In the drying stage of paper manufacture, the paper web shrinks more in the lateral areas than in the middle areas. This may even have the consequence that the paper in the lateral areas has a deteriorating effect on the other parts of the paper web. In view of the desired quality of the paper, it would be preferable that the shrinkage of paper is small and uniform.

In prior art methods, attempts have been made to avoid the above problem by increasing the negative pressure in the suction rolls arranged in the drying section. When the negative pressure is increased, the web shrinks less in the middle area, but the difference between the lateral areas and the middle area may even become larger. Thus, the result obtained by such a solution is not desirable.

One solution for the problem has been suggested in Finnish Patent Application No. 895928. In the solution provided therein, a profile of negative pressure that reduces the problem is applied just to a part of the path of the paper in the drying section. In addition, in Finnish Patent Application No. 861291, a lateral band solution is suggested, which provides for the prevention and equalization of the shrinkage through the entire path of the paper. Drawbacks of this method include wear of the lateral bands, how to make the bands remain in their grooves, and unusability of the lateral strip.

OBJECTS AND SUMMARY OF THE INVENTION

It is therefore an object of the present invention to provide a method and apparatus which substantially reduces and equalizes transverse shrinkage of paper in a single-wire draw in a drying section of a paper machine.

It is another object of the present invention to provide a new and improved method and device in which the drawbacks of the prior art devices are substantially eliminated.

In the method and apparatus of the present invention, it is an advantage that, when used in high speed machines, the paper runs on support of a wire through the drying section. Thus, the shrinkage of the paper web can be reduced and equalized by producing an adhesion force between the lateral areas of the wire and the lateral areas of the paper in the critical stage of drying. To provide an adhesion force in the lateral areas, it is possible to apply mechanical, chemical or electric means. It is one of the characteristic features of the present invention that by means of the hold profile produced in the wire in the single wire draw, the transverse shrinkage of the web is reduced and equalized. A further advantage of improved running quality is also obtained.

At the point of transfer from one drying group to the other, i.e., from one wire onto the other, it would be preferable to lower the intensity of the adhesion force.

If the adhesion force has been chosen suitably, it is however, possible to perform the transfer from one group to the other by means of a suction roll or equivalent.

Electrostatic forces can be utilized for the purpose in accordance with the invention by making use of the property of cellulosic fibers to produce a negative electric charge in the face of a paper web. When the material of the drying wire, in the lateral areas or across the entire width of the web, is chosen so that the wire charges itself statically or is charged with a positive electric charge, an electric force of attraction is produced between the paper and the wire.

The method in accordance with the invention is thus related in part to providing the lateral areas of the wire with adhesion means, whereby by means of the adhesion means, at the drying stage, an adhesion force is produced between the lateral areas of the wire and the lateral areas of the paper, whereby transverse shrinkage of the paper web is prevented. This adhesion is produced substantially without the application of external forces, such as pressurized air, suction, etc.

The apparatus of the present invention comprises, in the drying section of a paper machine, means for producing an adhesion agent at least in the lateral areas of the wire, whereby, by means of the adhesion agent, the holding force is increased by which the paper web is kept in contact with the wire face, whereby transverse shrinkage of the paper web is prevented efficiently.

In the present invention, the transverse shrinkage of the paper web is prevented by providing an adhesion force and/or friction in the lateral areas of the wire which correspond to lateral areas of the web. To achieve this, the wire is roughened or has a patterned coating or an adhesion agent applied onto the wire. The adhesion force is $F=\mu N$ wherein $\mu$ is the coefficient of friction and N is the normal force.

The present invention is directed to effecting a change on the coefficient of friction $\mu$, i.e., to vary the coefficient along the width of the wire and provide an increased friction in the lateral areas as opposed to the middle areas of the wire. Thus, friction faces on a wire in accordance with the invention will have a lateral area having a higher adhesion to the web than the middle areas of the web. As a result, the friction coefficient of the lateral areas is substantially higher than the friction coefficient of the middle areas.

In accordance with the invention, there is no need for separate actuating means to increase the normal force in the present invention, such as pressurized air, suction, etc., or particularly the pressing of the web against a wire having grooves such that the web will be caught and retained in the grooves. In such prior art embodiments using separate additional actuating means, the web is pressed into the wire by pressurized devices and lacking such force produced by the pressurized air, the web will not adhere to the wire.

However, in the present invention, there is no need for additional actuating devices as the holding force by which the web is held on the wire is produced by an increased coefficient of friction in the lateral areas of the wire.

It is important that in certain embodiments, the friction coefficient is maintained over the entire run of the web and wire through the drying section. In this manner, a continuous friction force is applied throughout the drying section in order to substantially prevent transverse shrinkage of the paper web. Therefore, from the point at which the web begins to run over the wire, i.e., in an initial press nip, until the point at which the web is separated from the wire, the friction force of the wire is continuous and uniformly applied to the web. In this manner, on the single-wire draw, the web runs continuously with the wire and while at all times the lateral areas of the web adhere with the same adhesion force to the wire.

It is another important feature of the present invention that the adhesion force between the lateral areas of the web and the corresponding lateral areas of the wire is achieved Substantially without the application of external forces, such as pressurized air, suction, etc. Rather, in the present invention, by controlling the coefficient of friction over the width of the wire, the desired adhesion force of the wire to the web are obtained.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
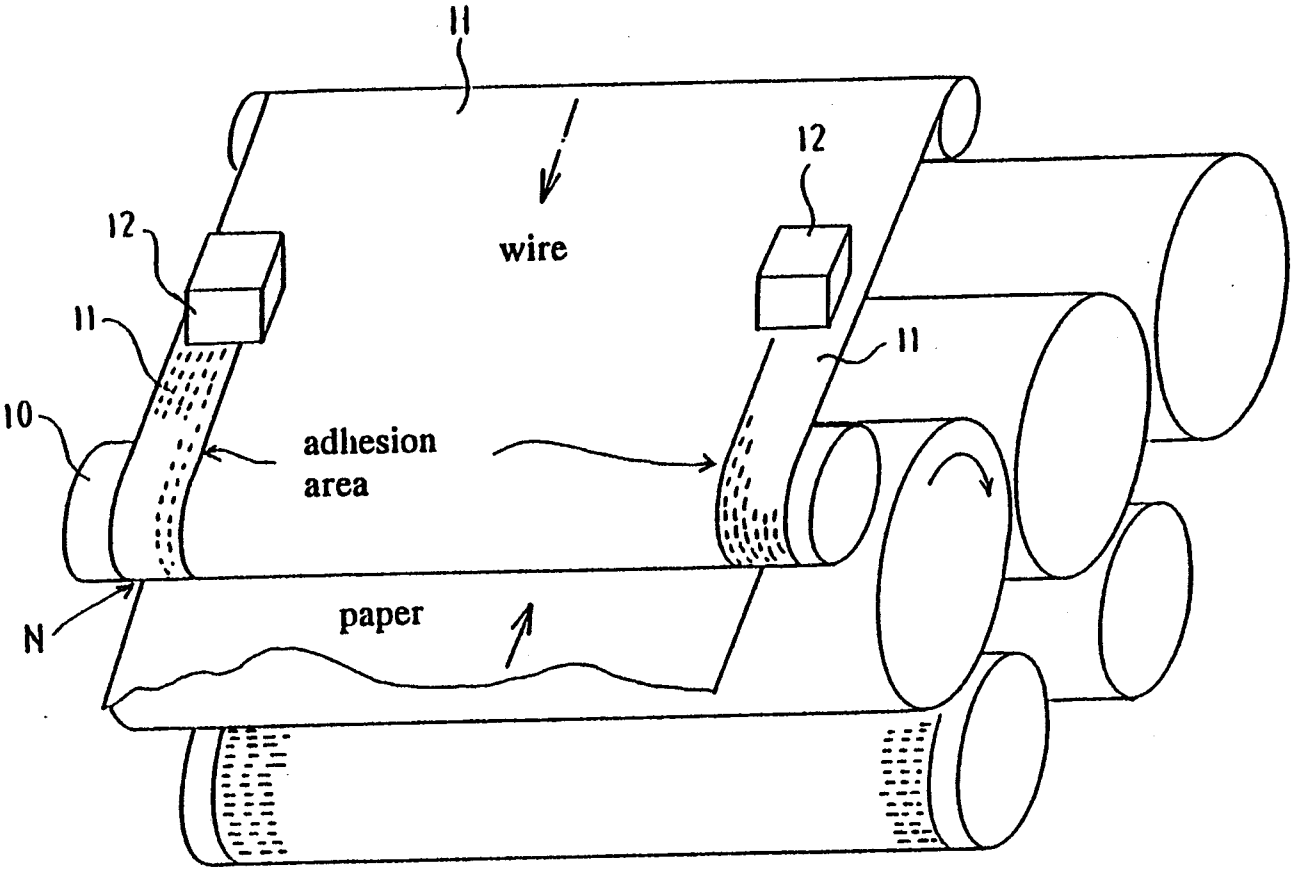
FIG. 1 is an axonometric view of a wire draw in the drying section of a paper machine in accordance with the present invention.

FIG. 1 is an axonometric illustration of the method and the equipment in accordance with the invention. A wire H is introduced into connection with a web W over a driving roll 10 such that the web will run with the wire H through the drying section. An adhesion agent or coating 11 is applied from an adhesion source 12 arranged before a nip N onto both of the lateral areas of the wire, i.e., at both sides of the wire. The adhesion agent 11 may consist of size, which adheres to the wire H face tightly after the nip N. Thus, by means of the application of the adhesion agent 11, a higher hold force is applied to the lateral areas of the paper web W than to the other areas of width on the web W. Transverse shrinkage of the web is substantially prevented by keeping the web in tight contact with the wire face by means of the adhesion agent 11. The composition of the size may be such that it evaporates or is dried during the drying, whereby a hold force can be provided in the areas of the drying section where a lateral hold is needed.

Figure 2:
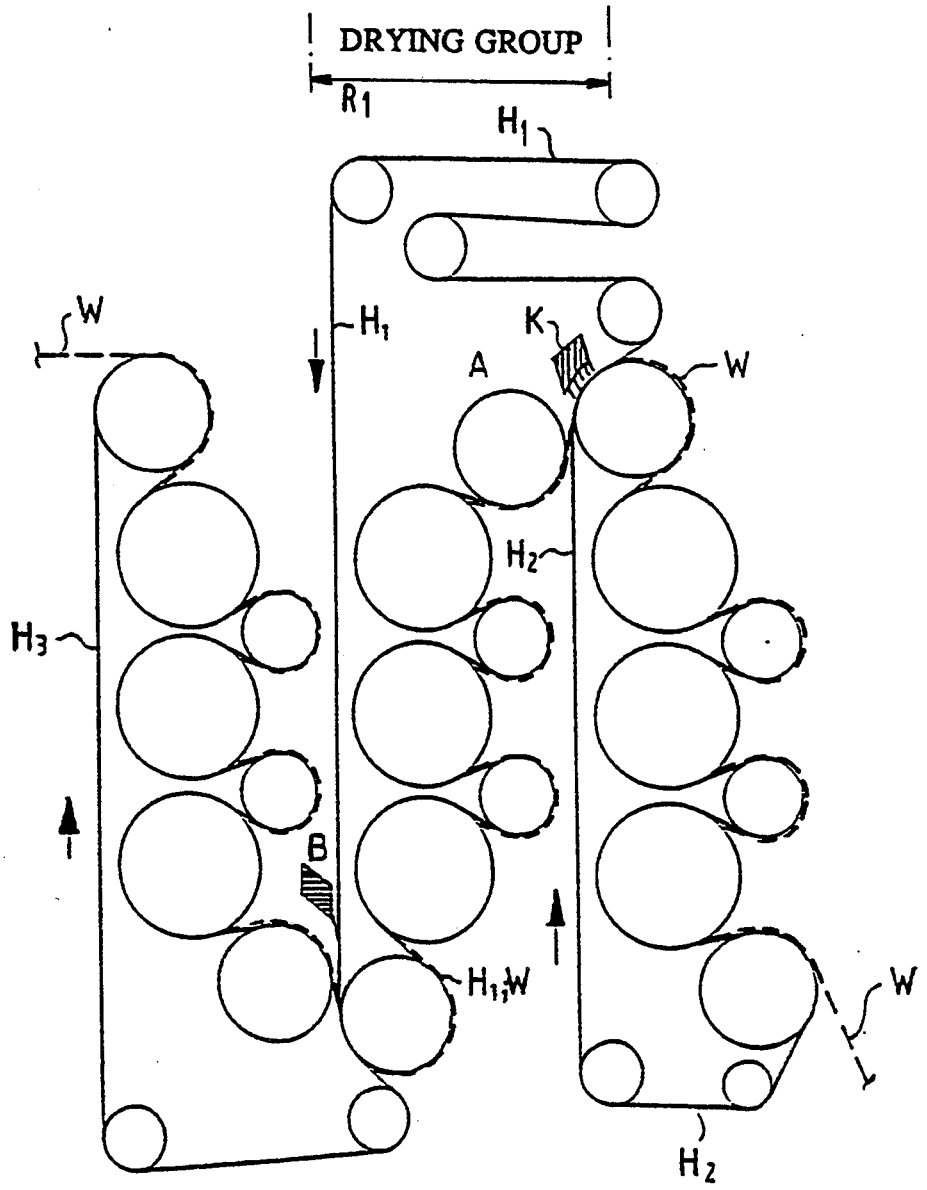
FIG. 2 is a schematic illustration of a second embodiment of the drying section of the present invention.
Figure 3:
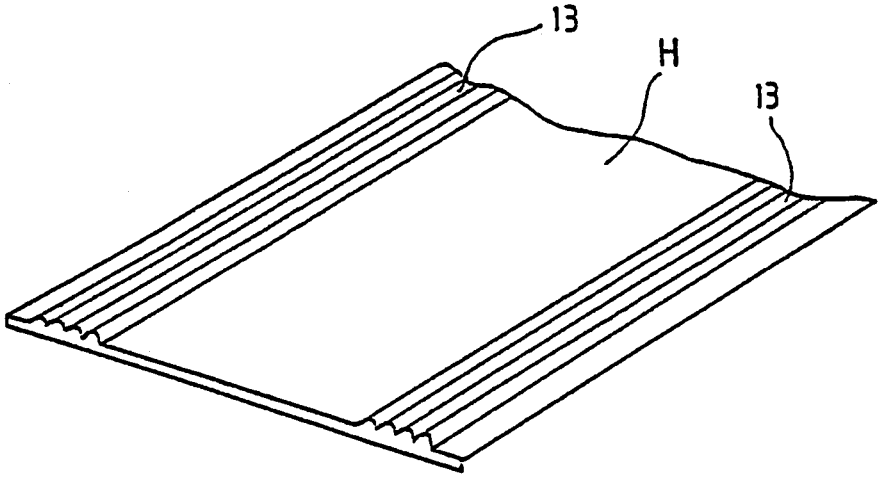
FIG. 3 shows a separate friction face in the lateral areas of the wire.

FIG. 2 is a schematic illustration of a drying section in which the drying cylinders are arranged in vertical groups in which wires $H_1$, $H_2$ and $H_3$ run. The adhesion agent 11 is introduced from an adhesion agent source 12 onto the wire face between the paper web W and the wire H. When the web is separated from the wire $H_1$ in the drying group $R_1$, the adhesion agent is removed in the after position A, e.g., by means of a doctor, from the face of the wire $H_1$. The adhesion agent is passed further back to the point B of spreading of the adhesion agent at the beginning of the wire draw of the group $R_1$. Thus, the transfer of the web from one drying group $R_1$ to the other drying group is promoted efficiently. In the gap between the drying groups, an equally high holding force should not be applied to the paper web in order that a smooth transfer from one group to the other would be permitted.

According to the invention, it is also possible to make the paper web W adhere to the wire H electrically. In this embodiment of the invention, electrostatic forces are utilized by making use of the properties of cellulosic fibers to produce a negative electric charge on the face of the paper web. The material of the drying wire in the lateral areas of the wire can be chosen such that it is statically charged during the run of the wire, and expressly with a positive electric charge. A positive electric charge can also be actively introduced at least into the lateral areas of the wire and/or the web. Thus, an electric force of attraction is produced between the paper and the wire, by means of which force the web is made to adhere to the wire. In this way, transverse shrinkage of the web is prevented electrically.

FIG, 3 shows another embodiment of the present invention. In accordance with the invention, the wire of the drying section is shown as provided with friction faces, preferably roughenings 13, in the lateral areas of the wire. The main principal is that the friction properties of the wire in its width positions are good, because a holding force is required expressly at the sides of the web to prevent shrinkage. According to the invention, this can be achieved, e.g., so that at the stage of manufacture of the wire, a pattern is applied to the lateral areas of the wire, whereby, by means of the pattern, the lateral areas of the wire are provided with the better properties of adhesion to the web than the middle areas of the wire are. In its lateral areas, the wire may be provided with an application, i.e., a separate coating, preferably a patterned coating or a raised pattern. The patterned coating is applied onto the wire and, as such, a special wire into which grooves have been formed is not required. This embodiment may be used alone or in conjunction with the embodiments depicted in FIGS. 1 and 2. The roughenings 13, or patterned coating, extend along the width of the wire from each sides to about 50 mm to about 500 mm inward from the outer edge of the wire.

FIG. 2 illustrates the feature of the web being carried through the drying section in a single-wire draw. It is an important feature that, as a result of the application of the coating, or adhesion means onto the lateral areas of the wire, the web runs together with the wire in the single-wire draw. The run of the web in conjunction with the wire begins at a point before a vertical group of drying cylinders and continues through the group of drying cylinders until the web is detached from the wire. There is no free draw of the web wherein the web runs unsupported between the drying cylinders in the drying group. In any such free draws, it is inherently impossible to obtain adhesion of the web to a wire and therefore, the friction viz. the coefficient of friction, will not be continuous nor uniform through the drying section. This non-uniform application of friction resulting from the interlude between any application of an adhesion force causes transverse shrinkage. However, in the present invention, the web runs through the drying section preferably in a continuous single-wire draw to maintain the coefficient of friction as uniform as possible and decrease the transverse shrinkage of the web.

In the present invention, the size of the lateral areas of the wire which is provided with an increased coefficient of friction is relatively wide, i.e., from about 50 mm to about 500 mm, and both lateral areas of the wire are provided with such increased adhesion means. In addition, as shown in FIG. 2, pressurized air is not applied to the web and wire in the single-wire draw in order to cause the adhesion of the web to the wire in the drying section. Thus, separate actuating means are not required in the present invention.

Figure 4:
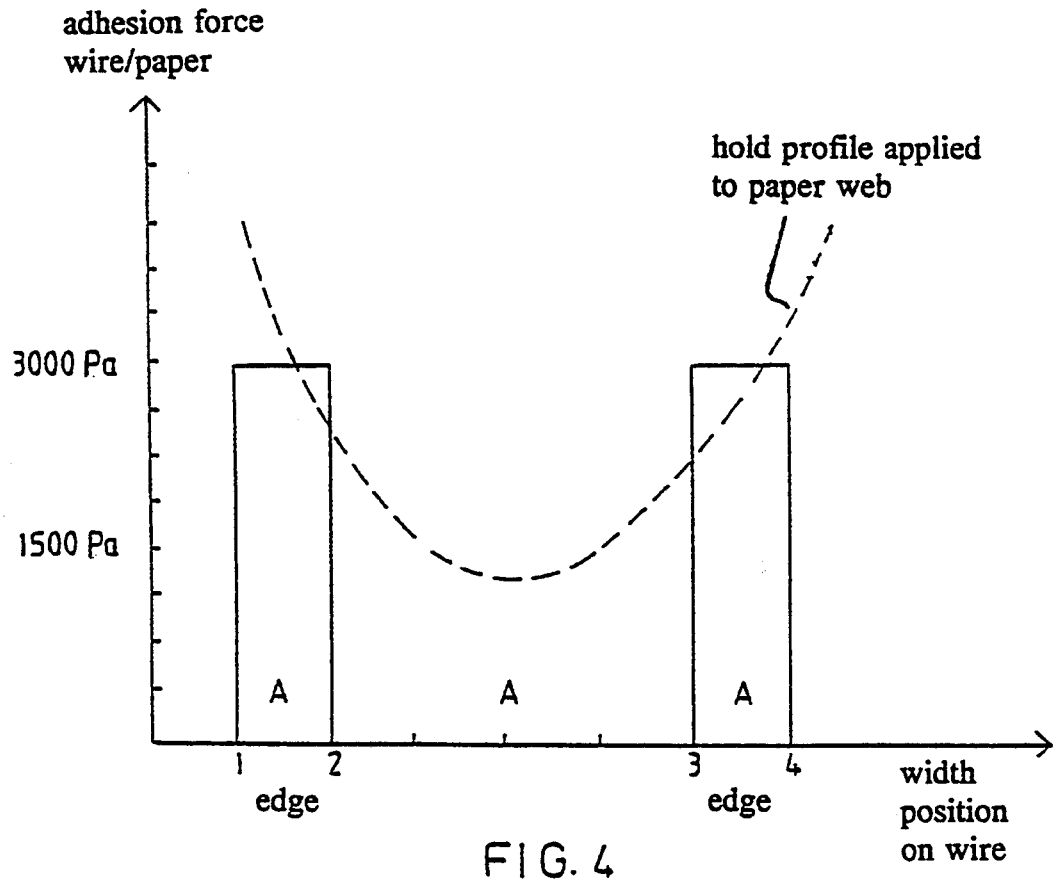
FIG. 4 shows a graph wherein the horizontal axis represents the width position on the wire and the vertical axis represents the adhesion force. The graph illustrates the hold profile applied to the paper web when adhesion increasing means are employed in the lateral areas of the wire.

FIG. 4 is a graphic illustration of the hold profile applied to the paper web W when a method and equipment in accordance with the invention are employed. The horizontal axis represents the width position on the wire, and the vertical axis represents the adhesion force applied to the wire and thereby to the paper. The wire width area is denoted with numerals 1 and 4. Between the wire width areas 1 and 2 as well as 3 and 4, there is an adhesion agent on the wire, for example, a size applied in the way illustrated in FIG. 1. The dashed line illustrates the hold profile applied to the paper web W.

Figure 5:
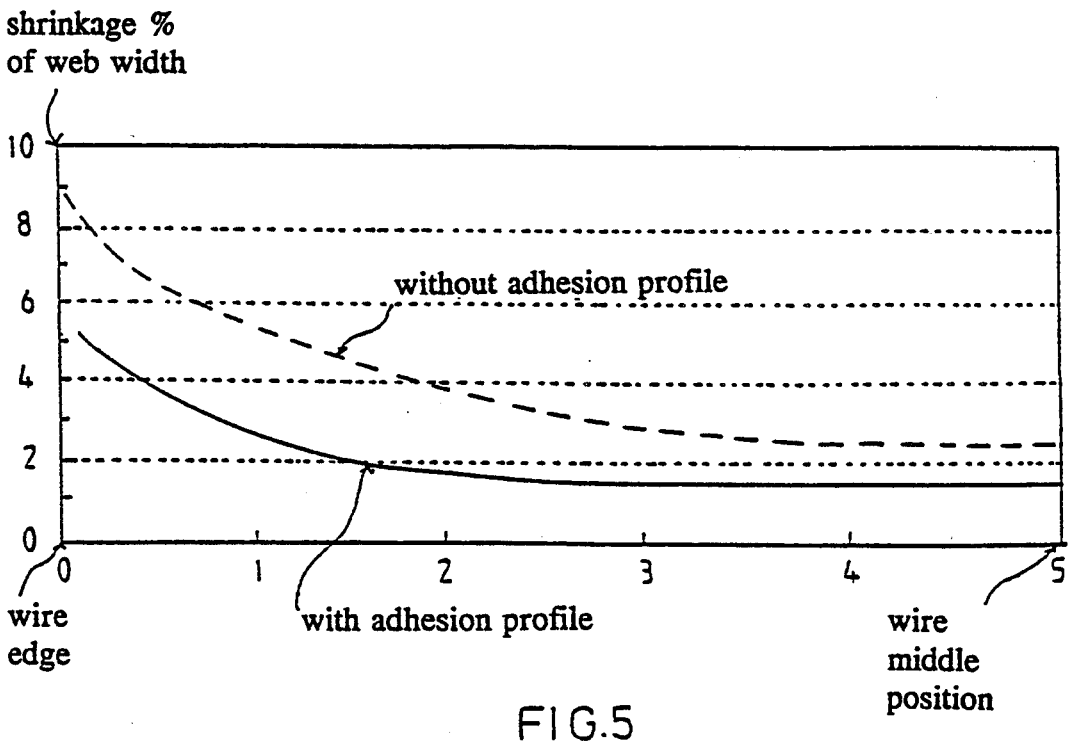
FIG. 5 illustrates the shrinkage as a percentage of the web width and as a function of the position of width on the web. In the graphs, the dashed line illustrates the conduct of the web when no increased adhesion in accordance with the invention has been employed in the lateral areas, and the solid line illustrates the conduct of the web when an increased adhesion in accordance with the invention has been employed in the lateral areas of the web.

FIG. 5 illustrates the shrinkage of the paper web as a percentage of the web width and as a function of the width position on the wire/web. The dashed line illustrates a case in which no adhesion means have been employed, and the solid line illustrates a case in which an adhesion increasing agent has been used, in particular in the lateral areas of the web. It is seen from the figure that the percentage of shrinkage has been lowered in all positions of width on the web/wire.

The examples provided above are not meant to be exclusive. Many other variations of the present invention would be obvious to those skilled in the art, and are contemplated to be within the scope of the appended claims.

We claim:

1. A method for the reduction and equalization of transverse shrinkage of a paper web, consisting essentially of the steps of:

providing a single wire draw in a drying section of a papermaking machine on which a paper web is carried in contact with a face of said wire, and applying an adhesion means consisting of a coating to lateral areas of said face of said wire such that said lateral areas of said face of said wire are provided with greater adhesiveness to the web than an area of said face of said wire between said lateral areas, said adhesion means causing the paper web to be kept in contact with said wire throughout the single wire draw in the drying section and substantially preventing transverse shrinkage of the paper web.

2. A papermaking drying section consisting essentially of:

a single wire draw in a drying section on which a paper web is carried in contact with a face of said wire, and adhesion means consisting of a coating in lateral areas of said face of said wire, said coating increasing the holding force such that the paper web is kept in contact with said face of said wire throughout the single wire draw in the drying section and substantially preventing transverse shrinkage of the paper web.

3. The drying section of claim 2, wherein said coating is a friction face applied onto the lateral areas of said face of said wire, whereby a higher adhesion of the paper web to said wire is produced in the lateral areas of said wire than in the other areas of said wire in the drying section.

4. The drying section of claim 2, wherein said coating comprises a patterned coating in the lateral areas of said wire is adheres to the paper web, said patterned coating providing a holding force between the lateral areas of said wire and the corresponding areas of the paper web to substantially prevent transverse shrinkage of the paper web in the drying section.

5. A wire draw in a drying section of a paper machine consisting essentially of:

a driving roll defining a nip in conjunction with a second roll, a wire running over said driving roll, a face of said wire contacting a paper web running over said second roll at said nip, said wire and the paper web having corresponding lateral areas and defining a single wire draw in the drying section, and adhesion means consisting of a coating arranged on the lateral areas of said face of said wire which contacts the paper web, the lateral areas of said face of said wire adhering to the corresponding lateral areas of the paper web after said nip throughout the single wire draw in the drying section, such that a higher holding force is applied to the lateral areas of the paper web than to the other areas along with the width of the paper web, said adhesion means substantially preventing transverse shrinkage of the paper web in the drying section.

6. The apparatus of claim 5, wherein said coating is a patterned coating.

7. The apparatus of claim 5, wherein said coating is roughenings which substantially increase the friction properties of the lateral areas of the wire.

8. The apparatus of claim 5, wherein a uniform adhesion force is applied by said coating to the web throughout the single-wire draw in the drying section.

9. The apparatus of claim 5, wherein the lateral areas of the wire have a higher coefficient of friction than a middle area of the wire between the lateral areas of the wire.

* * * * *